United States Patent [19]

Holoubek

[11] 4,007,900

[45] Feb. 15, 1977

[54] TUBE HANGER

[75] Inventor: George H. Holoubek, Muscatine, Iowa

[73] Assignee: Dart Industries Inc., Los Angeles, Calif.

[22] Filed: Oct. 20, 1975

[21] Appl. No.: 624,027

[52] U.S. Cl. ..... 248/311.1

[51] Int. Cl.[2] ..... B67D 5/06

[58] Field of Search ..... 222/180, 181, 95–101, 222/105; 248/108, 311 A, 311 R, 311.1, 311.3

[56] References Cited

UNITED STATES PATENTS

| | | | |
|---|---|---|---|
| 3,101,869 | 8/1963 | Baker | 248/108 X |
| 3,212,679 | 10/1965 | Schmidt, Jr. | 248/108 X |
| 3,446,468 | 5/1969 | Sakwa | 248/108 |
| 3,813,072 | 5/1974 | Moore | 248/311 A X |

*Primary Examiner*—Stanley H. Tollberg
*Assistant Examiner*—Norman L. Stack, Jr.
*Attorney, Agent, or Firm*—Kenneth J. Hovet

[57] ABSTRACT

A thin resilient plastic preform is provided for suspending a shampoo tube or the like having an elongated bottom sealing flange from a hook, showerhead, or faucet handle. The preform includes a tube attachment portion and a hanger portion. The hanger portion is adapted to engage conveniently located objects protruding from the shower wall and can comprise intersecting slits or a cut-out area in the plastic or a handle means. The tube attachment portion is an elongated straight cut through the plastic having a length about equal to the tube body width, but less than the length of the tube bottom sealing flange.

4 Claims, 6 Drawing Figures

TUBE HANGER

BACKGROUND OF THE INVENTION

1. Field of the Invention

The present invention relates to a means for suspending a tube from a wall projection.

2. Description of the Prior Art

As a tube of shampoo, hair conditioner or the like becomes depleted, it is frequently difficult to dispense the remaining portions from the tube. Since most materials are viscous in nature, one generally has to go through a laborious process of rolling the tube tightly or simply waiting until the viscous materials flow to the outlet end of the tube. Various ways have been devised to overcome this obstacle such as large dispensing closures having a top flat surface wherein the tube may be rested upon the closure itself in an inverted position. In this manner the viscous materials within the tube will have flowed by gravity to the dispensing end and be ready for immediate use without the usual squeezing or rolling of the tube.

Of course, it is also advantageous to have a tube of shampoo, hand cream, hair conditioner or the like located adjacent the bathtub, kitchen sink or shower stall where such are used. In general, this requires the use of hanging baskets, chains, shelves or the like. Frequently, these require extra care and cleaning, or generally become unsightly after a period of use—in addition to being somewhat expensive.

SUMMARY OF THE INVENTION

The present invention provides a simple economical means for hanging a tube in an inverted position at a location within reach in a kitchen, shower stall or bathtub environment. The invention comprises a flexible plastic part typically produced by cutting out a preform from a thin sheet of polyethylene. The plastic part includes a hanger portion for engagement with a wall projection and a tube attachment portion comprising an elongated cut through the thickness of the part and having an overall length about equal to the width of the tube body.

It is important that the tube include a sealing flange at its bottom or lower end which has opposing lateral ends which extend beyond the tube body proper. This sealing flange may be inserted into the cut which is dimensioned to be about equal to the aforementioned tube width, but less than the length of the sealing flange. In this way the ends of the sealing flange will engage the plastic part beyond the terminal ends of the cut-out thus locking the tube to the hanger portion.

The hanger portion of the plastic part may include one or more slits disposed in the central and/or upper portion of the plastic part. The slit(s) should be dimensioned to allow the plastic part to be slipped over a showerhead, faucet handle, wall hook or the like. Of course, any other type of cut-out, slit configuration, handle, cord or the like which will allow the part to be mounted upon wall projections will be suitable for the purposes of the present invention. Note that the hanger portion may be decorated or painted in a manner to enhance the total package.

DESCRIPTION OF THE PREFERRED EMBODIMENTS

Figure 1:
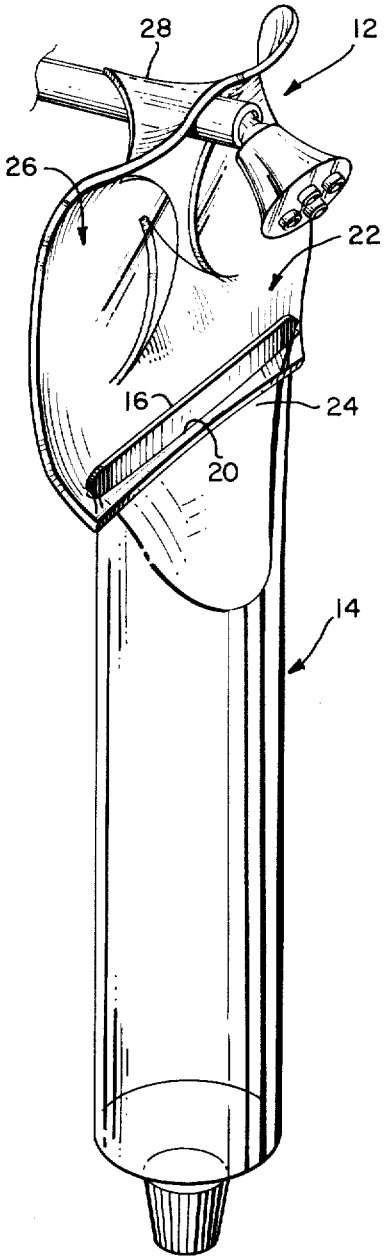
FIG. 1 is a perspective view showing the plastic part of the present invention mounted upon a showerhead and having suspended therefrom a tubular container.

Referring now to the drawings and, more particularly to FIGS. 1–4 thereof, the essential features of the plastic part 12 will be noted. The part comprises a thin, flexible plastic preform typically made from thin polyethylene sheeting. Conveniently, the preform can have a thickness from about 0.020 inches to about .030 inches. The plastic preform 12 may be cut or stamped from preprinted polyethylene sheeting and/or may be maintained as preprinted roll stock for dispensation from a store counter or the like. Although a somewhat rectangular shape is shown, it will be understood that various other designs may be utilized.

Figure 3:
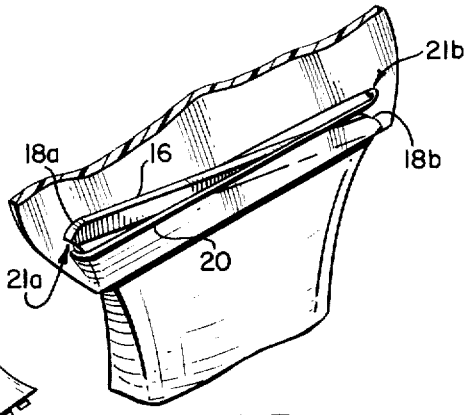
FIG. 3 is a fragmentary perspective view showing the sealing flange of the tube of FIG. 1 being inserted into the elongated cut in the plastic part of FIG. 1.

An important feature of the invention is the use of a tube 14 which is equipped with an elongated bottom sealing flange 16. The flange has opposing end portions 18 *a, b* that extend transversely beyond the tube body proper. The end portions cooperate with elongated cut 20 of the tube attachment portion 22 for engagement of the dispensing tube 14 with plastic part 12. Note that this engagement occurs by the opposing ends 18 *a* and *b* engaging the area of the plastic part 21 *a* and *b*, respectively, beyond where the cut 20 terminates. The engagement of the tubular container with the plastic part is best shown in FIG. 3 wherein end 18*a* is first inserted through the cut 20. Then the opposing end 18*b* (shown in phantom) may be flexed somewhat and pushed through the remaining portion of the cut 20. Upon release of the flexed sealing flange, the opposing end portion 18*b* will overlie area 21*b* and end 18*a* will overlie area 21*a*. Note that although the cut 20 is shown as straight, it may be serrated, toothed or have an undulating configuration depending on the sealing flange configuration and/or contour. It is desirable that the lower portion 24 of the tube be slightly less than the overall length of cut 20. In this way the tubular container will be firmly engaged within the confines of the cut 20 while still being suspended by the overlapping opposing ends 18 *a,b*.

The present invention includes a hanger portion shown generally by reference numeral 26. This portion may comprise one or more slits located about the central and/or upper portion of the plastic part 12. It is important that the slit be of a size sufficient to pass over a wall projection. For purposes of the present invention exemplary wall projections may be a showerhead, faucet handle, spout, wall hook, chain hook, peg, nail or the like.

Figure 2:
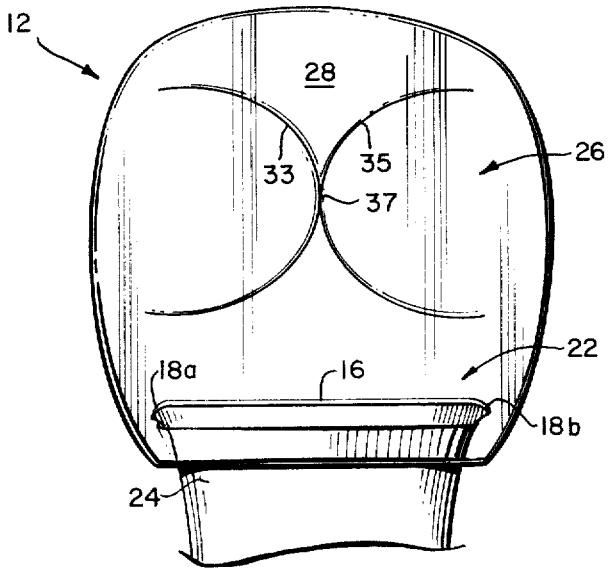
FIG. 2 shows a fragmentary front elevation view of the plastic part and tube shown in FIG. 1 when not mounted upon a wall projection.
Figure 4:
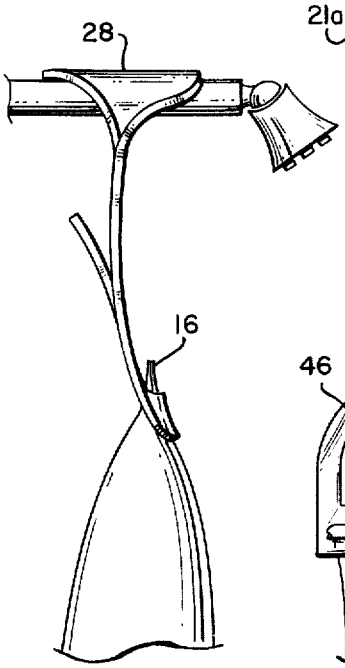
FIG. 4 is a fragmentary side elevation view of the assembly of FIG. 1.

In the embodiment shown in FIGS. 1, 2 and 4, two arcuate slits 33 and 35 are shown intersecting at a point 37 slightly above the center point of the plastic part. Of course, this creates flexible, flap-like structures which may be bent to allow the plastic part to be inserted over the showerhead. Note particularly the top flap 28 operating as a hanger for suspending the plastic part and tube assembly.

Figure 5:
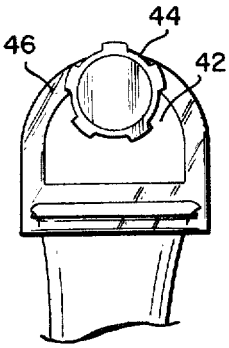
FIG. 5 is a reduced scale fragmentary front elevation view showing an alternative embodiment of the plastic part of FIG. 1.
Figure 6:
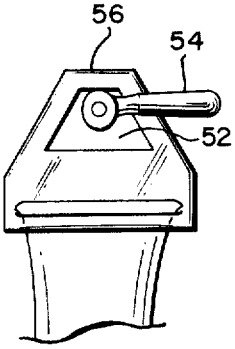
FIG. 6 is a reduced scale fragmentary front elevation view showing another embodiment of the plastic part of FIG. 1.

As aforementioned, the hanger portion 26 may include other configurations of slit(s) or it may include cut-out openings such as that shown in FIGS. 5 and 6. FIG. 5 illustrates an opening 42 which is of a size large enough to pass over valve knob 44. Note that the opening 42 creates an integral hanger portion 46 for suspending the plastic preform and tube assembly.

FIG. 6 illustrates an alternative embodiment having opening 52 adapted to pass over a valve handle 54. The preform and tube assembly are suspended on the handle 54 by an integral hanger portion 56. Note that for the purposes of the present invention a cord, rope, preformed handle or other type of hanger means would be the equivalent for each of the hanger portions 28, 46 and 56 illustrated.

It will be appreciated that the overall design of the plastic part may conform to the cut-out opening—as in FIGS. 5 and 6; however, the specific overall configuration of the plastic preform slits and/or openings are merely dictated by design choice. Of course, it will also be appreciated that while the specific embodiments shown are used over a showerhead or valve handle, the present invention may also have application in one's kitchen, workshop or other areas of a bathroom whereby tubular containers having toothpaste, cleansing compounds, creams, lotions, greases or the like may be suspended with the plastic part of the present invention.

While the invention has been described with respect to preferred embodiments, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

I claim:

1. A means for hanging a tube from a wall projection, said tube including a bottom sealing flange having a longitudinal dimension greater than the tube body width whereby the opposing lateral ends of said flange extend beyond the tube body proper comprising:

a thin flexible plastic part having a hanger portion for engagement with a wall projection and a tube attachment portion, said hanger portion comprising at least one slit and having a size sufficient to overlie a wall projection and said tube attachment portion comprising an elongated cut through said part having an overall length about equal to the width of said tube body and less than the longitudinal length of said tube bottom sealing flange whereby the opposing lateral ends of said flange will resiliently grip said plastic part proximate the area at each end of said elongated cut beyond where said cut terminates.

2. The means of claim 1 wherein said cut is substantially straight in configuration and is located adjacent a lower portion of said part.

3. The means of claim 2 including two slits intersecting at about said central area.

4. The means of claim 1 wherein said hanger portion includes an opening located about the central area of said part and having a size sufficient to overlie a wall projection.

* * * * *